United States Patent [19]

Dulin

[11] 4,332,197

[45] Jun. 1, 1982

[54] SELF-TENSIONING PRINTING CYLINDER LOCK

[75] Inventor: David L. Dulin, Fullerton, Calif.

[73] Assignee: Beach Manufacturing Corp., Huntington Beach, Calif.

[21] Appl. No.: 152,526

[22] Filed: May 22, 1980

[51] Int. Cl.[3] ..... B41F 1/28

[52] U.S. Cl. ..... 101/415.1

[58] Field of Search ..... 101/415.1, 378

[56] References Cited

U.S. PATENT DOCUMENTS

| | | | |
|---|---|---|---|
| 4,061,087 | 12/1977 | Hill | 101/415.1 |
| 4,133,264 | 1/1979 | Fermi et al. | 101/415.1 |
| 4,154,167 | 5/1979 | Czinger | 101/415.1 |

*Primary Examiner*—William Pieprz
*Assistant Examiner*—David J. Isabella
*Attorney, Agent, or Firm*—Fulwider, Patton, Rieber, Lee & Utecht

[57] ABSTRACT

A self-tensioning printing cylinder lock for fitting longitudinally in grooves formed between printing saddles on diametrically opposite sides of a printing press cylinder. Such lock includes a longitudinally extending base plate having a longitudinally elongated tensioning bar disposed in overlying relationship with respect thereto. The opposite extremities of such bar are urged toward an extended position away from the saddle edge by a pair of identical springs to thus maintain such bar to a positioned aligned longitudinally with the printing cylinder as a result of such biased spring tension. Consequently, as the length of such printing plate mounted on the saddle varies during operation, the tensioning bar will draw the transversely opposite sides of such printing plate toward such extended position with uniform force to maintain the plate tensioned irrespective of variation in plate length.

4 Claims, 10 Drawing Figures

SELF-TENSIONING PRINTING CYLINDER LOCK

BACKGROUND OF THE INVENTION

1. Field of the Invention

The self-tensioning printing saddle lock of the present invention relates to a locking device for securing a photosensitive printing plate to a printing cylinder in a rotary printing press.

2. Description of the Prior Art

In the printing industry it has been common practice to provide flexible metallic photosensitive printing plates having a raised image on one side thereof for reproduction as such plate travels around with a printing cylinder in a rotary printing press. Since such metallic plates are not reusable, the expense thereof to a company printing numerous different flats or pages of images is considerable. This is particularly true for the newspaper industry where 50 or even 100 different pages of print and artwork reproduction may take place daily. Efforts have been made to devise paper printing plates which can be manufactured for less than half the cost of metallic photosensitive plates. However, such paper printing plates are typically dimensionably unstable when exposed to different humidity and temperature levels. Consequently, the circumferential dimension of such paper plates may vary as much as 1/16 of an inch in the circumferential direction as it travels about with such cylinder. Such variations in printing plate dimensions render present day locking devices incorporated in rotary printing cylinders unsatisfactory for holding such paper printing plates firmly on the cylinders since such locks cannot accommodate such variations in length. Printing saddle locks have been proposed which include a floating tensioning bar biased to a central or neutral position by means of a single spring and then incorporate circumferentially extending alignment grooves for receipt of alignment screws to roughly maintain the tensioning bar parallel to the saddle edge. A device of this type is shown in U.S. Pat. No. 4,154,167, assigned to the assignee of the instant application. Such saddle locks, while being satisfactory for dimensionally stable printing plates, have proven unacceptable for dimensionally unstable printing plates since it is economically unfeasible to form the alignment pins and slots with the necessary precision to maintain the required tension bar alignment to provide uniform tensioning force to the opposite sides of a printing plate which may progressively change in dimension during the printing operation. Consequently, there exists a need for a self-tensioning printing saddle lock which will maintain a certain degree of tension on the paper printing plate itself as the dimensions thereof vary to thus maintain the printing plate under tension to closely fit the periphery of the printing saddle irrespective of such variations in dimensions. Although various printing cylinder lockup systems have been in use for more than 15 years on many different types of printing presses for locking printing plates thereon, the need for a self-tensioning on-cylinder lockup system has not been satisfied. The self-tensioning lock of the present invention not only accommodates the dimensional instability of paper plates, but the plates may be mounted thereon with either end at the lead end of the saddle.

SUMMARY OF THE INVENTION

The self-tensioning printing saddle lock of the present invention is characterized by alignment and biasing means interposed between the printing plate cylinder and an axially elongated floating tensioning bar mounted thereon to maintain such tensioning bar in alignment with the axis of the cylinder as such tensioning bar is shifted circumferentially relative to the cylinder to thereby maintain such tensioning bar squared with one end of a dimensionally unstable printing plate to which it is coupled.

These and other features of the invention will become apparent from a consideration of the following detailed description of the drawings.

DESCRIPTION OF THE PREFERRED EMBODIMENT

Figure 2:
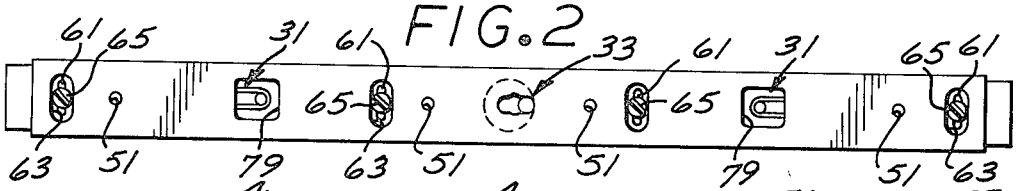
FIG. 2 is a bottom plan view of the self-tensioning printing saddle lock shown in FIG. 1.
Figure 3:
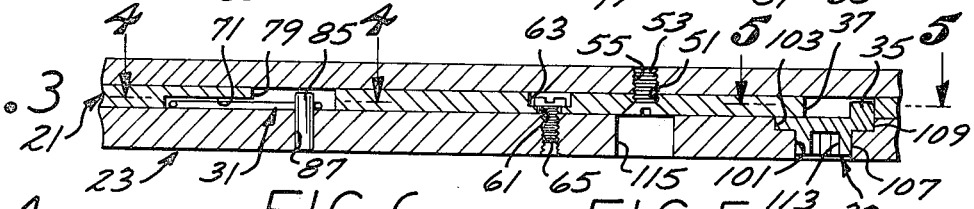
FIG. 3 is a longitudinal sectional view, in enlarged scale, taken along the line 3—3 of FIG. 1 and rotated 180°.
Figure 5:
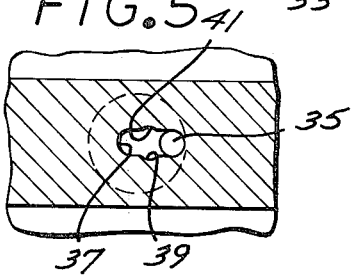
FIG. 5 is a longitudinal sectional view taken along the line 5—5 of FIG. 3 and depicting the tensioning bar in its neutral position.

The self-tensioning printing cylinder apparatus of the present invention includes, generally, an axially elongated base plate or bar 21 (FIGS. 3 and 8), mounting a coextensive tensioning bar 23 thereover for floating in a circumferential direction with respect to the printing cylinder 25. Referring to FIGS. 2 and 3, the base plate 21 mounts a pair of identical springs, generally designated 31, spaced on equidistance on opposite sides of a centrally located, cylindrical retractor cam, generally designated 33. The retractor cam 33 includes a follower pin 35 projecting from one side thereof and received in an axially elongated cam slot 37 (FIGS. 5 and 6), which is formed centrally in its opposite sides with respective detents 39 and 41 such that rotation of the cam 33 counter clockwise from its neutral position as shown in FIG. 5, will cause the tensioning bar 23 to be shifted circumferentially on the printing cylinder 25 downward toward one side of the base plate 23. Continued rotation to the over-the-center position shown in FIG. 6, will register the follower pin 35 with the detent 41 to releasably lock such tensioning bar retracted toward the lower side of such base plate 21 as viewed in FIGS. 2 and 7. One end of a paper printing plate, generally designated 45 (FIG. 7), may then be coupled with the tensioning bar 23 and the cam 33 rotated in either direction to release such tensioning bar to be drawn back toward its neutral position by the balanced force of the springs 31 to thus assume an intermediate tensioning position maintaining an even tension on opposite sides of such printing plate, irrespective of any variations in plate length which may result from growth or shortage during operation.

The base plate 21 is mounted on the cylinder 25 and is generally rectangular in shape and may be constructed with a plurality of countersunk radially extending mounting bores 51 spaced longitudinally therealong for receipt of respective mounting screws 53 which may be screwed into threaded bores 55 formed in the periphery of the printing cylinder 25.

To assist in maintaining alignment of the tensioning bar 23 with respect to the base plate 21 and the cylinder 25, four circumferentially extending radially through alignment slots 61 are formed in equally spaced locations along the length of the base plate 21 and are formed on their undersides with generally oblong shaped undercuts to define recesses 63 for receipt of the respective recessed heads of tensioning plate mounting screws 65 (FIGS. 2 and 3).

Figure 4:
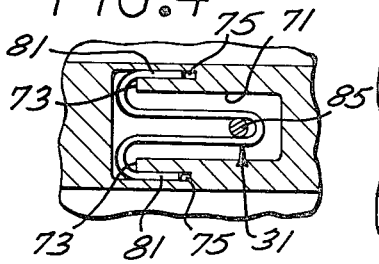
FIG. 4 is a longitudinal sectional view taken along the line 4—4 of FIG. 3.

The mounting plate 21 is formed on its top side with a pair of longitudinal radially outwardly opening rectangularly shaped pockets 71 (FIGS. 2 and 4), disposed equidistance on opposite sides of the retractor cam 33. Referring to FIG. 4, the axially outer ends of the respective pockets 71 T-shaped in plan view with the cross thereof extending laterally outwardly from the body thereof to form respective circumferentially extending shoulders 73 which have narrow slots 75 projecting axially inwardly therefrom on opposite sides of the pocket 71, and open radially outwardly toward the biasing bar 23. Referring to FIG. 3, the radially inner bottom wall of the pockets 71 are formed at their axially inner extremities with generally square windows 79 opening radially inwardly through such plate toward the printing cylinder 25.

Referring to FIGS. 2, 3 and 4, the springs 31 are generally hairpin shaped and have their opposite extremities turned outwardly away from one another and back on themselves to form turned back anchoring hooks 81 received snugly within the slots 75. The body of the hairpin shaped springs 31 project axially in the respective slots 71 and have their free ends hooked over radially projecting pins 85 press fit into respective bores 87 (FIG. 3), formed in the tensioning bar 23. It will be apparent to those skilled in the art that the form of the springs 31 and anchoring hooks 81, may take many different configurations and that the present invention is not limited to the configuration shown.

Figure 1:
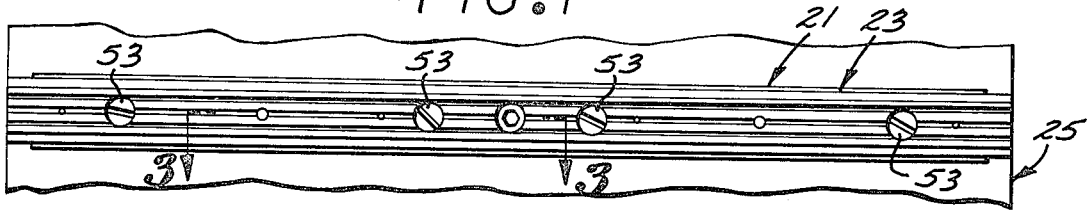
FIG. 1 is a partial plan view of a self-tensioning printing saddle lock of the present invention mounted on a printing cylinder.
Figure 8:
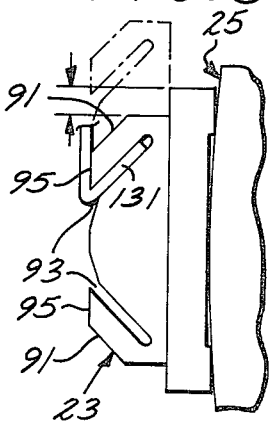

Referring to FIGS. 1, 3 and 8, the tensioning bar 23 is generally rectangular in plan view and is formed on the circumferentially opposite edges of its radially outer side with respective longitudinal 45° chamfers 91. Formed parallel with such chamfers are axially extending coupling slots 93 which open radially outwardly and cooperate with the chamfers 91 in forming respective longitudinal coupling hooks 95 projecting at 45° to the radius of the cylinder 25.

Referring to FIGS. 1 and 3, the tensioning bar 23 is formed centrally with a radially extending through, stepped retractor-receiving bore 101 which is counterbored on its radially inner extremity to form an enlarged-in-diameter bore 103 overlying the cam slot 37 in the base plate 21. The retractor cam 33 is formed with a radially outwardly projecting cylindrical boss 107 received freely in the bore 101 and is formed centrally with an enlarged-in-diameter cam disc 109. The cam follower pin 35 projects radially inwardly from such cam disc 109 and is disposed off center on such cam. The cylindrical boss 107 is formed centrally with radially outwardly opening allen wrench-receiving hexagon shaped rocket 113.

Still referring to FIGS. 1 and 3, the tensioning bar 23 is further formed with for longitudinally spaced apart radial access bores 115 which, in the tensioning bar neutral position, overlie the heads of the mounting screws 53 for access thereto by the blade of a screwdriver when the lock of the present invention is being mounted on a printing cylinder 25.

It will be appreciated that the self-tensioning lock of the present invention may take numerous different forms, as for instance, being in the form of a tensioning bar hinged to the base plate 21 and that the bar itself may be formed with numerous different plate coupling means, as for instance, projecting pins for fitting in complimentary eyes formed in the edges of the printing plates 45 or even magnetic bars for attracting ferromagnetic printing plates or elements thereof to the tensioning bar itself. However, in the case of the disclosed embodiment, the self-tensioning lock of the present invention is intended to be mounted in axially extending grooves 121 (FIG. 7), formed between the axial edges of semicylindrically shaped printing saddles 123 mounted on the diametrically opposite sides of the printing cylinder 25.

Figure 7:
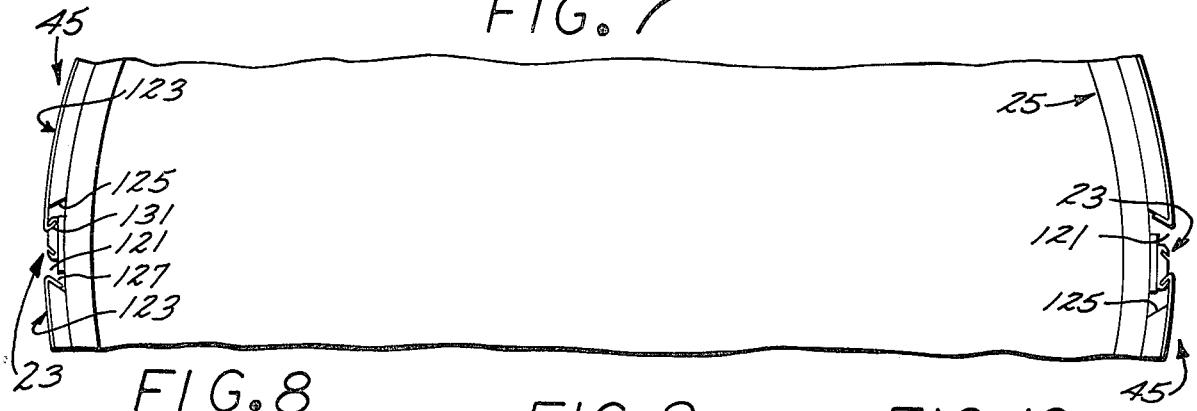
FIG. 7 is a partial end view, in reduced scale, showing a pair of self-tensioning saddle locks of the present invention mounted on opposite sides of a printing cylinder; and, FIGS. 8, 9 and 10 are right hand end views, in enlarged scale, of the self-tensioning saddle lock shown in FIG. 1 and depicting the tensioning bar in its neutral retracted position, fully extended tensioning position, and intermediate extended tensioning position, respectively.

Referring to FIG. 7, the printing saddles 123 are conveniently undercut along their axially opposite sides to form cutback coupling edges 125. The printing plates 45 are then formed on one end with a radially inwardly directed turned back attachment legs 127 for hooking over the edge 125 of the saddle 123 and being trapped in place between such undercut edge and the surface of the printing cylinder 25. The opposite end of the printing plates 25 are then also formed with turned back lips 131 (FIGS. 7–10), which are formed to complimentarily fit within the respective slots 93 behind the coupling hooks 95 of the tensioning bar.

The paper printing plates 45 (FIG. 7), may be of any desirable construction such as that marketed by Letterflex and may, if desirable, be reinforced with metal stiffeners affixed to the opposite ends thereof.

Figure 6:
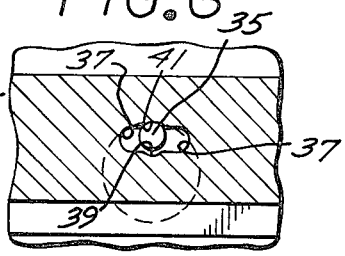
FIG. 6 is a longitudinal sectional view similar to FIG. 5 but depicting the tensioning bar in its retracted position.

In operation, when it is desirable to mount a self-tensioning saddle lock of the present invention on a printing cylinder 25 formed with the grooves 121, the base plate 21 may be merely centered in such grooves between the saddle edges 125 and bores 55 (FIG. 3), drilled and tapped in the cylinder for the screws 53. The screws 53 may then be inserted to anchor the base plate 21 in position. When it is subsequently desirable to load the cylinder 25 with the dimensionally unstable printing plates 45, an allen wrench tool may be inserted in the sockets 113 of the retractor cams 33 of the tensioning bars 23 to rotate such cams and cause the follower pins 35 to be displaced to one circumferential side of the cams 33 thus carrying the tensioning bars 23 from their neutral position and pushing them to the opposite side of the base plate 21 to their fully retracted positions adjacent the edges 125 of the saddles on which the printing plates 45 are to be mounted. When the individual follower pin 35 registers with the detent 41 as shown in FIG. 6, such tensioning bar 23 will be releasably locked on its fully retracted position. The lip 131 on the one extremity of the printing plate 45 may then be hooked onto the undercut edge 125 of one of the saddles 123 and the body of such printing plate then peeled onto such saddle 123. The workman loading such cylinder may then manipulate the printing plate to fit the turned back lip 131 on the opposite end losely in the groove 93 (FIG. 8). The retractor cam 33 may then be rotated to disengage the follower pin 35 from the detent 41, thus freeing the tensioning bar to be urged toward its position extended away from the saddle edge 125 under the uniform, balanced force of the springs 31 to thus maintain uniform tension on the opposite sides of the printing plate 45 on the saddle surface. The cylinder 25 may then be advanced and the opposite saddle 123 then loaded with a printing plate 45 in a similar manner.

Figure 9:
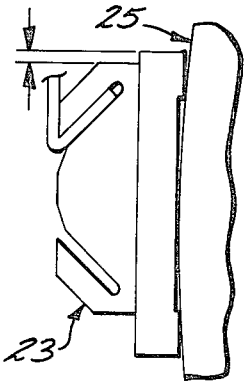
Figure 10:
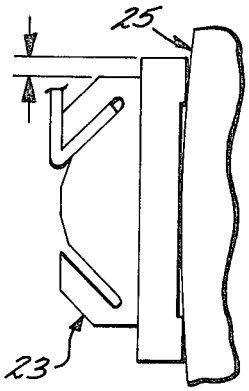

The printing press is then ready for operation and as the plate 45 passes under the burning lamp in the printing press, the moisture in the plate 45 will be reduced, thus shrinking such plate and causing it to draw the tensioning bar 23 toward the saddle 123 to an intermediate extended position as shown in FIG. 9. Since such shifting of the tensioning bar 23 is against the balanced force of the springs 31, uniform tension will be maintained on opposite sides of the printing plate, thus maintaining it uniformly tensioned against the periphery of the printing saddle 123. As the printing plate progresses from under the burning lamp, it will again pick up humidity from the atmosphere and grow somewhat on the saddle, thus permitting the tensioning bar 23 to be shifted further away from the saddle to an extended position, shown in FIG. 10, all the while maintaining uniform tension on the opposite sides of such printing plate. When it is subsequently desirable to remove the printing plate 45 from the saddle, an allen wrench style tool may be inserted in the socket 113 and the retractor cam 33 rotated to again shift the subject tensioning bar 23 to its retracted position shown in broken lines in FIG. 8 and registering the follower pin 35 with the detent 41 to lock such tensioning bar in its retracted position until such time as the saddle 25 is to again be reloaded.

From the foregoing it will be apparent that the self-tensioning saddle lock of the present invention provides an economical and convenient means for mounting a dimensionably unstable printing plate on a printing saddle and maintaining a uniform tension thereon irrespective of shrinkage or growth of the plate during the printing process. Moreover, the particular compact self-tensioning saddle lock may conveniently and economically be substituted for existing locks on printing presses to adapt such printing presses for receipt of relatively economical to produce paper printing plates.

I claim:

1. A printing press clamping apparatus mounted in a longitudinal groove formed by a printing cylinder apparatus and comprising:

an elongated tensioning bar disposed longitudinally in said groove for translation laterally therein from a medial position to oppositely disposed first and second retracted positions and formed with top and bottom sides, as well as lateral sides, formed with a centrally disposed bore opening downwardly into said bottom side:

a base plate in the form of a bar interposed between said tensioning bar and the bottom of said groove;

a pair of spring pockets formed in one of said bars at locations spaced equidistant on opposite longitudinal sides of said bore;

a pair of spring anchors projecting into said respective pockets and mounted with the other of said bars;

a pair of dual acting spring means disposed in said respective pockets and interposed between said spring anchors and said one of said bars to urge said tensioning bar to said tensioning medial position, said spring means having substantially equal spring rates to urge the opposite extremities of said tensioning bar to said medial position with substantially equal force;

said base bar being formed with an elongated follower receiving slot disposed at the open end of said bore and formed on its opposite sides with oppositely disposed detents;

fastening means for fastening said clamping apparatus to said cylinder apparatus; and a retractor formed with a cylindrical body received freely rotatable in said bore and including an eccentrically disposed follower projecting longitudinally from said bore into said slot, said actuator being rotatable in said bore to orbit said follower to one lateral side to engage one side of said slot and, upon further rotation of said actuation, positively push said tensioning bar to the opposite lateral side to said first retracted position and to register said follower with one said detent to releasably lock said bar in said first retracted position, and said retractor being further rotatable to disengage said follower from said detent and to orbit it to engage the opposite side of said slot and upon further orbiting, to positively push said bar to said second retracted position.

2. A printing press clamping apparatus as set forth in claim 1 wherein:

said tensioning bar is formed with a pair of oppositely disposed, open top, parallel, longitudinally extending, printing plate-receiving slots converging and angling upwardly toward said top side and converging inwardly toward one another.

3. A printing press clamping apparatus as set forth in claim 1 wherein:

said spring pockets are formed in said base plate, are open toward said bottom side, and are T-shaped at said bottom side, the cross of said T-shaped pockets forming shoulders;

said base plate further including slots opening toward said bottom side of said tensioning bar and extending longitudinally into said plate from said shoulders;

said spring means includes U-shaped springs disposed longitudinally into said base plate from said shoulders;

said spring means includes U-shaped springs disposed longitudinally in said respective pockets, the opposite ends thereof being turned back and received in said slots; and wherein said spring anchors are in the form of pins projecting from said tensioning bar into said respective pockets and engaging the closed ends of said respective springs.

4. A printing press clamping apparatus as set forth in claim 1 wherein:

said pockets are elongated in the longitudinal direction of said tensioning bar;

said spring means includes elongated springs mounted on their respective one ends to said one bar at the respective ends of said pockets and projecting longitudinally into said respective pockets to form free ends; and said anchors engage said respective free ends of said springs.

* * * * *

UNITED STATES PATENT AND TRADEMARK OFFICE

CERTIFICATE OF CORRECTION

PATENT NO. : 4,332,197

DATED : June 1, 1982

INVENTOR(S) : David L. Dulin

It is certified that error appears in the above—identified patent and that said Letters Patent is hereby corrected as shown below:

Column 2, Line 51, before equidistance delete "on" and insert --an--;

Column 3, Line 26, after (FIGS. 2, delete "and 4";

Column 3, Line 29, after 71, insert --are--;

Column 6, Line 3, after one of said, insert --tensioning--;

Column 6, Line 4, after said, delete --tensioning--;

Column 6, Line 49, insert after springs, --each having an open end and a closed end--.

Signed and Sealed this

*Fourteenth* Day of *December 1982*

[SEAL]

*Attest:*

GERALD J. MOSSINGHOFF

*Attesting Officer*

*Commissioner of Patents and Trademarks*